US009073111B2

(12) United States Patent
Araki

(10) Patent No.: US 9,073,111 B2
(45) Date of Patent: Jul. 7, 2015

(54) MOLDING DEVICE FOR PULLING OPEN ELONGATED HOLES IN PIPES OR SHEETS

(75) Inventor: Katsuki Araki, Yokohama (JP)

(73) Assignee: ARAKI TECHNICAL AND RESEARCH CO., LTD., Kanagawa (JP)

( * ) Notice: Subject to any disclaimer, the term of this patent is extended or adjusted under 35 U.S.C. 154(b) by 0 days.

(21) Appl. No.: 13/982,115

(22) PCT Filed: Jan. 24, 2012

(86) PCT No.: PCT/JP2012/051449

§ 371 (c)(1), (2), (4) Date: Oct. 8, 2013

(87) PCT Pub. No.: WO2012/102271

PCT Pub. Date: Aug. 2, 2012

(65) Prior Publication Data

US 2014/0020443 A1 Jan. 23, 2014

(30) Foreign Application Priority Data

Jan. 27, 2011 (JP) ..... 2011-015320

(51) Int. Cl.
*B21D 31/02* (2006.01)
*B21D 19/08* (2006.01)
(Continued)

(52) U.S. Cl.
CPC ..... *B21D 19/08* (2013.01); *B21D 28/285* (2013.01)

(58) Field of Classification Search
CPC ..... B21B 19/04; B21B 23/00; B21C 37/104; B21C 37/292; B21C 37/205; B21C 37/15; B21C 37/06; B21D 28/28; B21D 28/285
USPC ..... 72/367.1, 368, 370.01, 370.16, 370.23, 72/370.24, 370.27, 55, 70, 71, 324, 329, 72/330, 333, 336, 337, 20.4, 54.71, 112, 72/125, 370.08, 466.8, 393; 29/90.01, 29/428, 446
See application file for complete search history.

(56) References Cited

U.S. PATENT DOCUMENTS 2,895,356 A * 7/1959 Cogsdill ..... 408/200
3,592,038 A * 7/1971 Larikka ..... 72/325
(Continued)

FOREIGN PATENT DOCUMENTS

JP 03-090221 4/1991
JP 09-103827 4/1997
JP 2003-001331 1/2003

OTHER PUBLICATIONS

Japanese Office Action dated Apr. 16, 2013 filed in the corresponding Japanese Patent application No. 2011-015320.
(Continued)

*Primary Examiner* — Shelley Self
*Assistant Examiner* — Lawrence Averick
(74) *Attorney, Agent, or Firm* — Rankin, Hill & Clark LLP

(57) ABSTRACT

A high-tolerance molding device that uses a pulling technique to quickly form a desired elongated hole in a workpiece such as a pipe or a sheet with little material loss, due to the use of single-piece molding, while preventing material degradation. The workpiece is provided with a pilot hole that is smaller than but roughly concentric with the desired elongated hole. This molding device includes a power-coupling arm that can be inserted into the pilot hole; a control unit that controls the movement of the power-coupling arm; and a molding plug that is prepositioned on the opposite side, with respect to the power-coupling arm, of the surface of the workpiece in which the pilot hole is provided.

1 Claim, 7 Drawing Sheets

(51) Int. Cl.

| | |
|---|---|
| ***B21D 28/28*** | (2006.01) |
| *B21C 37/29* | (2006.01) |
| *B21D 41/02* | (2006.01) |

(56) References Cited

U.S. PATENT DOCUMENTS

| | | | | |
|---|---|---|---|---|
| 4,992,010 | A * | 2/1991 | Fischer | 408/159 |
| 5,135,338 | A * | 8/1992 | Heule | 408/187 |
| 5,209,617 | A * | 5/1993 | Heule | 408/178 |
| 5,704,743 | A * | 1/1998 | Goorsenberg | 408/159 |
| 5,848,860 | A * | 12/1998 | Steiner | 408/159 |
| 6,430,812 | B1 * | 8/2002 | Sanders | 29/890.148 |
| 7,420,109 | B2 * | 9/2008 | Wasser et al. | 84/385 R |
| 2008/0083315 | A1 * | 4/2008 | Wasser et al. | 84/380 R |
| 2010/0166515 | A1 * | 7/2010 | Heule et al. | 408/186 |
| 2010/0232895 | A1 * | 9/2010 | Heule et al. | 408/59 |

OTHER PUBLICATIONS

International Search Report dated May 15, 2012 filed in PCT/JP2012/051449.

* cited by examiner

MOLDING DEVICE FOR PULLING OPEN ELONGATED HOLES IN PIPES OR SHEETS

TECHNICAL FIELD

The present invention relates to a device that forms a desired elongated hole in a molding target piece, e.g., a pipe or a sheet by a pulling technique, and more particularly to a high-tolerance molding device that uses a pulling technique to quickly forma desired elongated hole in a molding target piece with little material loss, due to the use of single-piece molding, while preventing material degradation.

BACKGROUND

In conventional examples, to form an elongated hole in a pipe as a workpiece (can manufacturing), a hole 1 is formed in the pipe so as to have such a shape as shown in a plane view (a lower view) of FIG. 1(*a*), and another material bent in the same shape is welded to manufacture a can.

However, according to the conventional can manufacturing method, since a box portion, which turns to a frame of an opening after the pipe is subjected to fusion cutting and an elongated hole opening portion is provided, is formed by welding, material degradation occurs due to the welding, or a highly skilled welding operator is necessary and forming requires a long time. Further, there also arises a problem that material loss occurs in the opening portion with a large opening actual dimension.

Therefore, applying a molding method adopted in conventional pipe arrangement and performing pulling machining has been considered. Since the molding adopted in the conventional pipe arrangement is circular forming and a stress of the pulling machining is provided at one central point only, it is sufficient to insert an arm from the center, connect it to a cored bar, and give pulling power. However, in molding of the elongated hole, balance cannot be kept in the pulling that uses force at one point, and the only method is gradually effecting the molding while performing adjustment (correction). Therefore, although a method for increasing the number of molding cores to two can be considered because the elongated hole is to be formed, if a connection method produces an error in length, distortion is accumulated in the arm that requires large force, a problem in proof stress occurs, a stress in molding that is applied to a machine further spreads to a workpiece, and normal molding is hard to be carried out. Therefore, a molding shaft has to be linear. Actually, an eccentric error applied to the workpiece in the early stage expands as the molding advances, and the connected shaft skids with larger force and bends after all.

DISCLOSURE OF INVENTION

Problem to be Solved by the Invention

To solve the above-described problem, it is an object of the present invention to provide a high-tolerance molding device that uses a pulling technique to quickly form a desired elongated hole in a molding target piece such as a pipe or a sheet with little material loss, due to the use of single-piece molding, while preventing material degradation.

Means for Solving Problem

As a result of concentrating on studies, the present inventor obtained knowledge that a pilot hole 2 smaller than a desired hole which is to be formed by plastic working is previously provided in a pipe (a workpiece) as shown in a plane view (a lower view) of FIG. 1(*b*) and a device comprising pipe integral molding means for integrally operating a molding plug 3 arranged in the pipe with external pulling force applied from the upper side by using a specific mechanism, i.e., means for moving the molding plug 3 from the lower side (the inside of the pipe) toward the upper side (the outside of the pipe) as shown in a side elevation (an upper view) of FIG. 1(*b*) can be achieved.

The present invention is based on the above-described knowledge and provides the following inventions.

1. A molding device that pulls open a desired elongated hole in a molding target piece such as a pipe or a sheet, comprising:

an arm that moves in a direction substantially perpendicular to a surface of the molding target piece in which a pilot hole is provided, and is configured to be inserted into an opening portion of the pilot hole, the molding target piece having the pilot hole, which is smaller than but substantially concentric with the elongated hole, provided therein;

a control unit that controls movement of the arm; and a plug that is previously arranged on the opposite side of the arm with respect to the surface of the molding target piece in which the pilot hole is provided, configured to engage with and operate integrally with the arm, and has a plane area associated with the elongated hole.

2. The molding device according to 1, wherein the arm is a power-coupling arm that is coupled with a cylinder rod, which gives power, at an end portion on the opposite side of the side where the arm engages with the plug.
3. The molding device according to 1 or 2, wherein the arm has a claw configured to engages with the plug, and an operation of the claw is controlled by the control unit.
4. The molding device according to 3, wherein the claw is a butterfly claw that allows the plug to be coupled with or released from the power by a butterfly-like operation.
5. The molding device according to any one of 1 to 4, further comprising a molding external die configured to hold the molding target piece at a predetermined position.
6. A molding manufacturing method for pulling open a desired elongated hole in a molding target piece such as a pipe or a sheet with the use of the molding device according to any one of 1 to 5, the method comprising:

moving the arm from the upper side toward the lower side of the pilot hole in the direction substantially perpendicular to the surface of the molding target piece in which the pilot hole is provided upon receiving a signal from the control unit, the molding target piece having the pilot hole, which is smaller than but substantially concentric with the elongated hole, provided therein; and engaging the arm with the plug and moving them from the lower side toward the upper side of the pilot hole by an integral operation.

Effect of the Invention

According to the present invention, at a time of pulling open a desired elongated hole in a molding target piece such as a pipe or a sheet, it is possible to provide the high-tolerance molding device that uses a pulling technique to quickly form, without highly skilled welding labor, the desired elongated hole with little material loss (saved to approximately 30%), due to the use of single-piece molding, while preventing material degradation.

The molding device according to the present invention has performance that reduces destructive accidents caused due to accumulation of metal degradation in a welding area, which is unavoidable in a conventional welding manufacturing method, as cyclic fatigue such as vibration of typhoons or earthquake that affects a pole.

Moreover, according to the present invention, a molded body that has the elongated hole with improved strength around the opening portion can be provided.

BEST MODE(S) FOR CARRYING OUT THE INVENTION

The present invention will now be described based on its preferred embodiment hereinafter with reference to the drawings.

(Entire Configuration of Molding Device)

Figure 2:
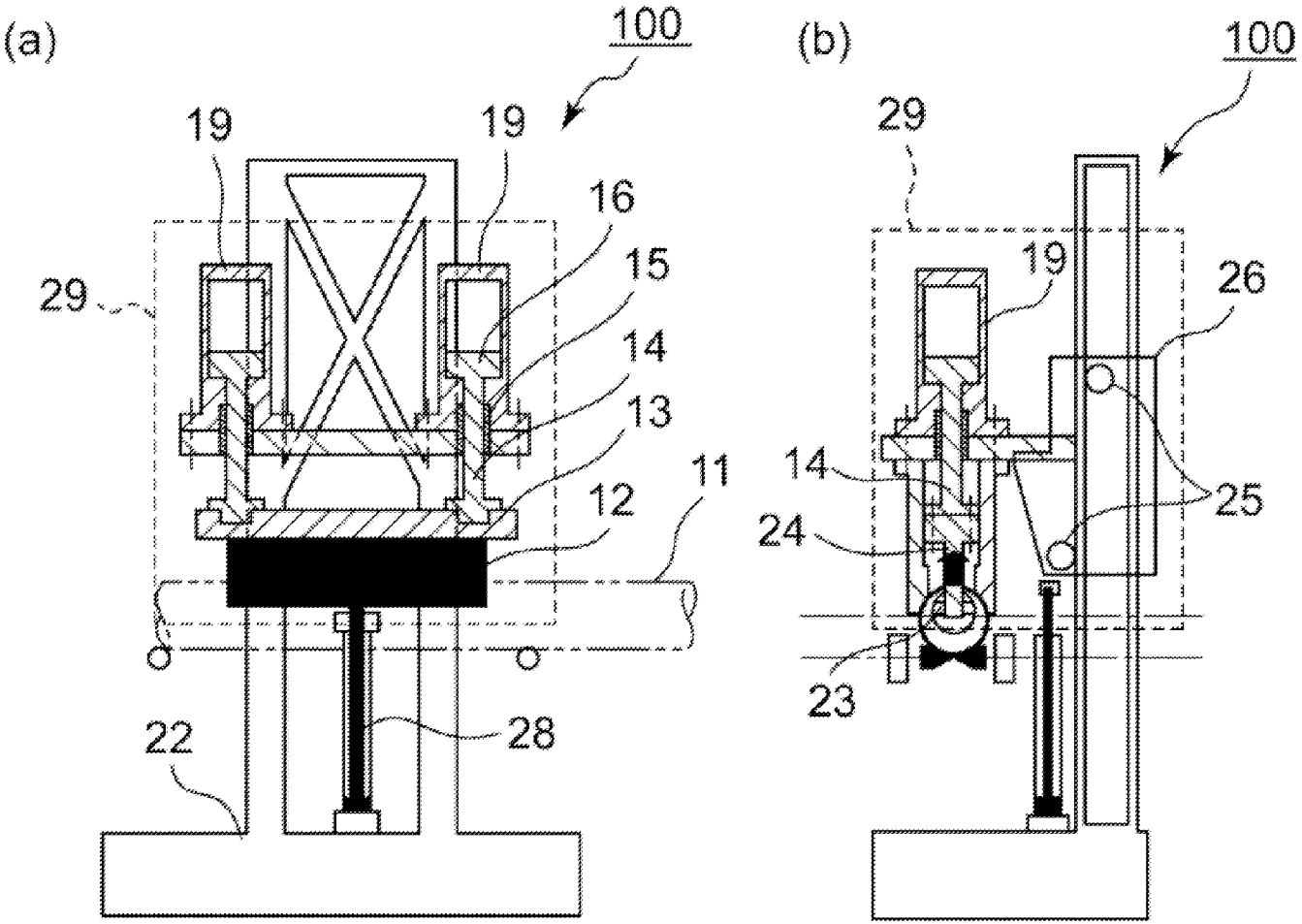
FIG. 2(*a*) is a front view showing a molding device according to an embodiment of the present invention, and FIG. 2(*b*) is a right side elevation of the molding device in FIG. 2(*a*)

FIG. 2(*a*) is a front view showing a molding device according to an embodiment of the present invention, and FIG. 2(*b*) is a right side elevation of the molding device in FIG. 2(*a*). Additionally, FIG. 3(*a*) is a view showing a state that molding is finished in the molding device in FIG. 2(*b*), and FIG. 3(*b*) is a view showing a state that a molding unit is further moved upward from the FIG. 3(*a*) state.

As shown in FIGS. 2(*a*) and (*b*), a molding device 100 according to this embodiment is a molding device configured to pull open a desired elongated hole in a molding target piece, e.g., a pipe 11 as a workpiece, and comprises an L-shaped frame (a frame base which looks like an L shape as seen in a left side elevation) 22 constituted of a base portion and a column portion, a molding unit (a portion surrounded by a dotted line: a power unit) 29 that is supported on the column portion of the L-shaped frame 22 by a lift bracket 26 and provided on the column portion of the L-shaped frame 22 so as to be movable in the vertical direction by a plurality of guide rollers 25, and a unit lift-up (up-down) cylinder 28 which is placed at the center on the base portion of the L-shaped frame 22 as seen from the front side and moves up and down the molding unit 29.

Here, the molding unit 29 is constituted of a molding external die 12 that is in contact with and arranged on an upper portion of the pipe 11 in order to fix and hold the pipe 11 set at a predetermined position, a die base 13 that is coupled with and supports the molding external die 12, a molding plug (a die) 23 that is previously arranged in the pipe 11 before molding, an arm 24 that engages with the molding plug 23 and pulls up the molding plug 23 at the time of molding, a cylinder rod 14 that is coupled with an end portion of the arm 24 which is on the opposite side of the side where the arm 24 engages with the plug 23 and supplies power to the arm 24 upon receiving a signal from a control unit (not shown), a rod guide metal 15 that is placed on the lateral periphery of the rod 14 and stabilizes an operation of the same, a piston 16 that is directly connected to the rod 14, and a main cylinder (an actuator) 19 that accommodates the piston 16 so as to be operable in the vertical direction.

It is to be noted that the molding unit 29 of the molding device 100 according to this embodiment includes two left and right main cylinders 19 and 19 each accommodating the arm 24, the cylinder rod 14, the rod guide metal 15, and the piston 16.

Figure 1:
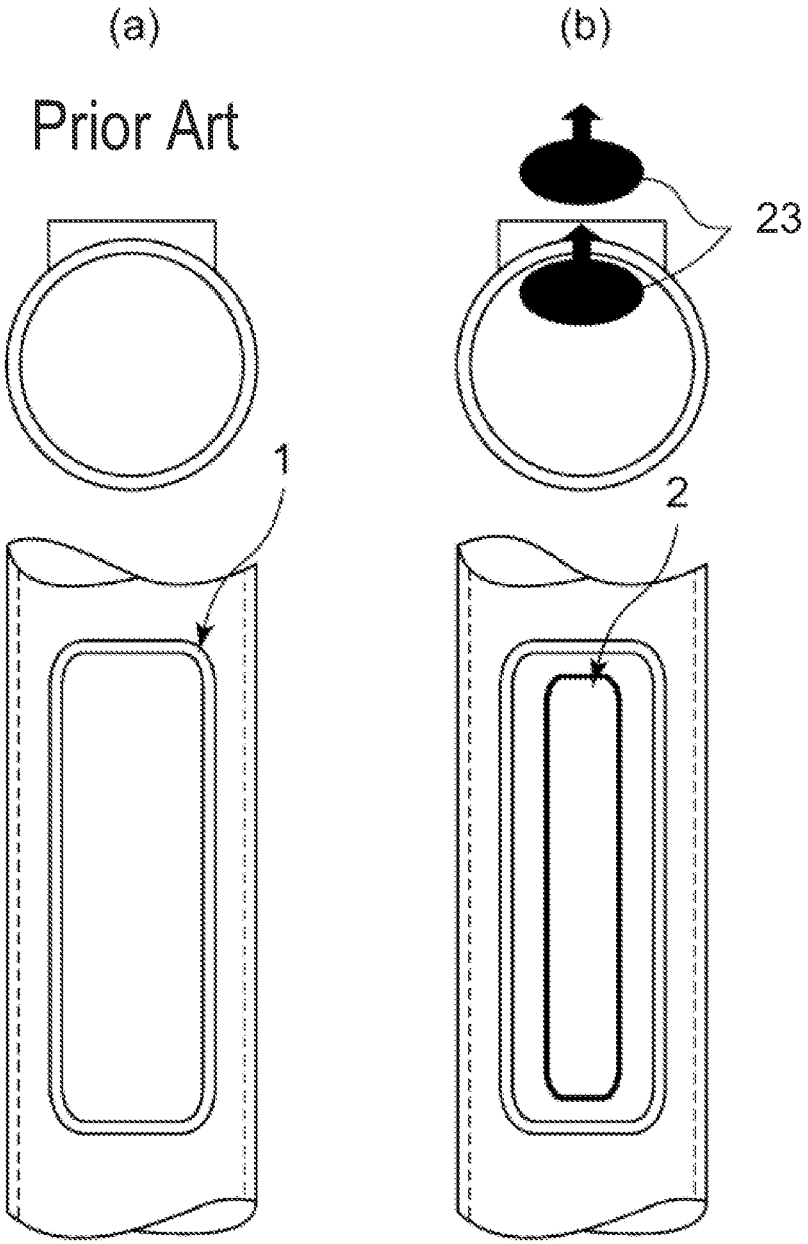
FIG. 1(*a*) is a plan view (a lower view) of a pipe in a process according to a conventional can manufacturing method and a side elevation (an upper view) after the can manufacturing, and FIG. 1(*b*) is a plan view (a lower view) of a pipe (a workpiece) as an example of a plastic forming target of a molding device according to the present invention and a side elevation (an upper view) showing an image of its molding process.

As the pipe 11 that is a molding target piece of the molding device 100 according to this embodiment, there is used a pipe that has a pilot hole, which is smaller than a desired elongated hole and allows the arm 24 to be inserted therein, provided therein in advance in such a manner that pilot hole can be placed to substantially concentric with the desired elongated hole to be formed, and this pipe is set at a predetermined position shown in FIG. 1. The pilot hole of the elongated hole is not processed by this molding device 100, and it is opened in a preparation process, e.g., NC milling or NC air plasma.

The arm 24 can move in a direction substantially perpendicular to a surface of the pipe 11 in which the pilot hole is provided and can be inserted into the opening portion of the pilot hole. The movement of this arm 24 is controlled by the control unit so that an appropriate operation is carried out. It is preferable for the pilot hole of the pipe 11 to have a size that is approximately 30% of an area of the elongated hole to be formed.

The molding plug 23 is previously arranged on the lower side that is the opposite side of the arm 24 placed above the surface of the pipe 11 in which the pilot hole is provided. When the molding device 100 according to this embodiment operates, the arm 24 moves from the upper side toward the lower side with respect to the pilot hole, the molding plug 23 engages with the arm 24, and these members move up by an integral operation. The molding plug 23 having a plane area associated with the elongated hole is used. Furthermore, as the molding plug 23, there is used one having a flat shaft configuration with rigidity in order to prevent a function of an invisible moment on a shaft from being amplified for formation of the elongated hole and from resulting in a breakage failure.

In this embodiment, since the arm 24 that engages with the molding plug 23 is a power-coupling arm that is coupled with the cylinder rod 14 that gives power, a drawing thrust produced from the cylinder rod 14 is transmitted, and an accurate operation is enabled.

Further, in this embodiment, since the molding external die 12 is provided, the pipe 11 can be firmly fixed so that it does not move at the time of molding. As a result, the elongated hole can be formed into an appropriate shape, and distortion or the like can be prevented from being produced in the elongated hole opening portion of a resultant molded body. Further, each main cylinder 19 is provided with a cylinder base 17, and the cylinder base 17 plays a role as a space for means that provides a puling distance at the time of molding.

To set the pipe 11 as a workpiece, a plug holding arm (a fixed arm, see FIG. 9) holds the molding plug 23 from its one end, and the workpiece is moved in such a manner that the molding plug 23 held by the plug holding arm can be arranged at an accurate position.

Before the molding performed by the molding device 100 according to this embodiment, as shown in FIG. 2(*b*), the molding plug 23 arranged in the pipe 11 and the power-coupling arm 24 to which power from the cylinder rod 14 in the molding unit 29 is transmitted are set.

It is to be noted that, in this embodiment, the main cylinders 19 and 19 are hydraulic cylinders, these members perform molding on the pulling side, and hence the small and light-weight molding unit 29 can be obtained.

In this embodiment, although the cylinder rod 14 is moved by each hydraulic cylinder, a mechanism or a wedge whose force acts in a direction of 90 degrees may be used besides a fluid pressure. Although the mechanism or the wedge is used when these members have the same shape and they are very frequently used, using these members is not general since the number of peripheral dies increases. Using a motor to directly convert rotation into linear motion leads to high frictional wear and large loss, whereas a hydraulic pressure is simple, enables using an extreme pressure, and can realize miniaturization, and hence the latter is preferable.

In case of using this molding device 100 for molding, the same pressurized fluid is put into the rod sides of the two main cylinders 19 and 19, an opposite action of an operation on the cylinder side structurally integrated with the molding external die 12 that avoids deformation of the pipe 11 is exerted on the cylinder rod 14 coupled with the molding plug 23, and an action of a shear moment turns to an action of plastic deformation from the restrained pipe 11.

Figure 3:
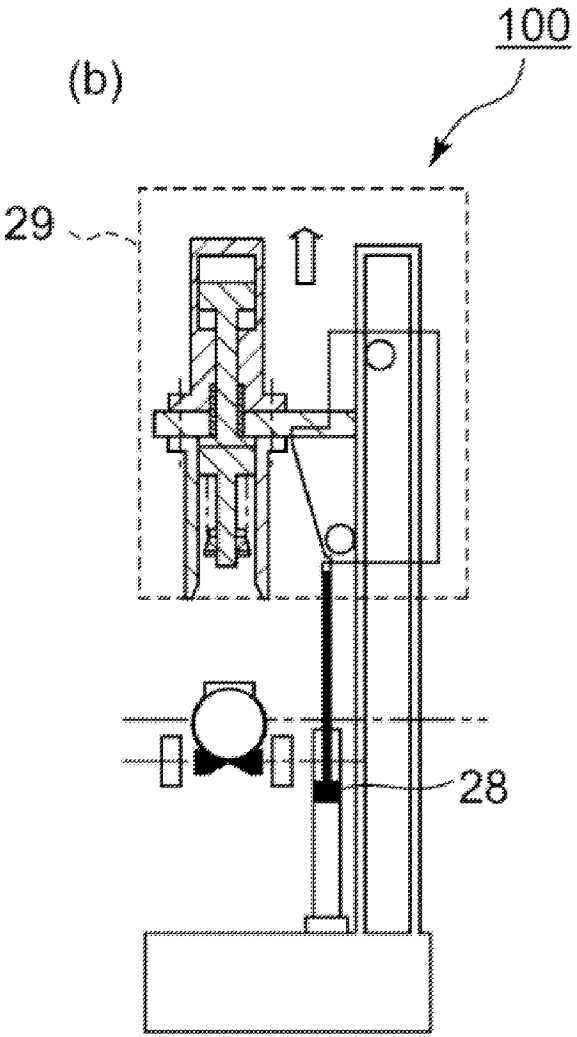
FIG. 3(*a*) is a view showing a state that molding is finished in the molding device in FIG. 2(*b*), and FIG. 3(*b*) is a view showing a state that a molding unit is further moved to the upper side from the state in FIG. 3(*a*)
Figure 3:
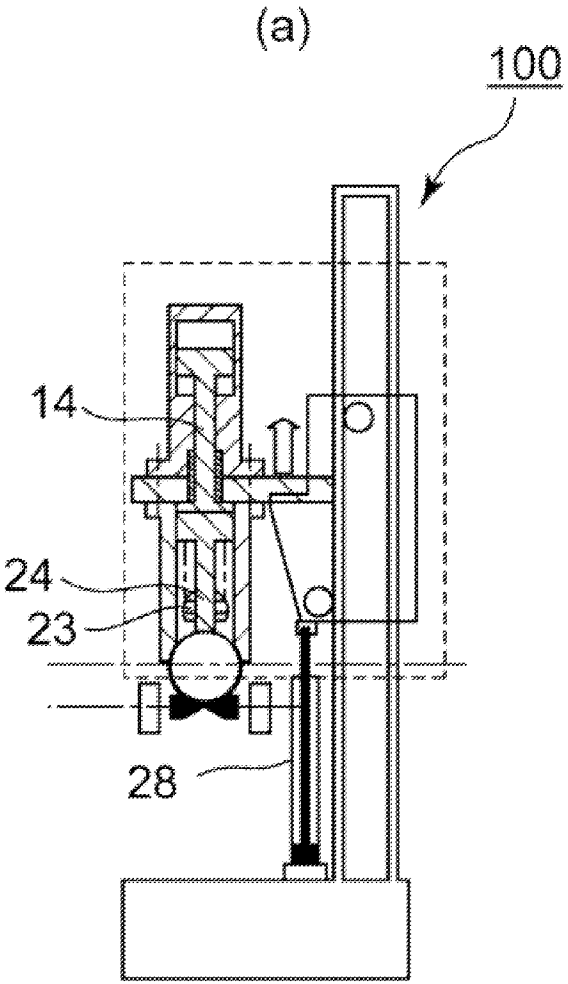

When the molding is finished, as shown in FIG. 3(*a*), positions of each cylinder rod 14 and the molding plug 23 are raised to be higher than a position of the pipe 11.

Further, as shown in FIG. 3(*b*), the molding unit 29 is moved up by the unit lift-up cylinder 28 until it reaches a predetermined position. At this time, the pipe 11 is opened while being movable, the molding is completed in this state, and the pipe 11 is moved in a pipe axis direction.

It is to be noted that, in the molding device according to this embodiment, the example where the desired elongated hole is pulled open in the pipe has been described, but the present invention is not restricted thereto, and it can be appropriately applied to an example where a desired elongated hole is pulled open in any other molding target piece such as a sheet.

(Detail of Primary Part of Molding Unit)

A configuration and an operation of a primary part of the molding unit will now be described in detail.

Figure 4:
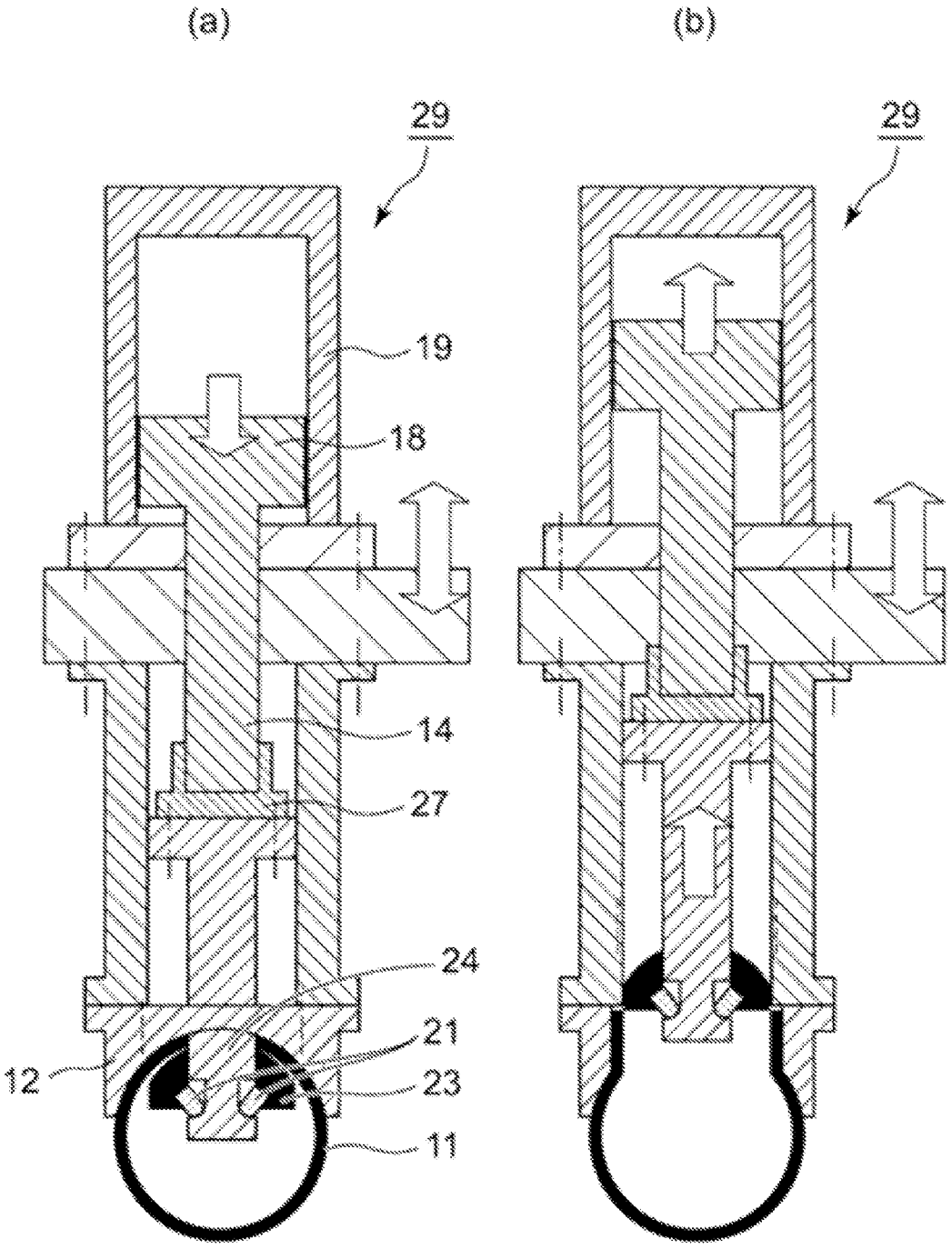
FIG. 4(*a*) is a schematic cross-sectional view showing a primary part of the molding unit in a standby mode before molding (plastic deformation) in a molding process performed by the molding device according to an embodiment of the present invention, and FIG. 4(*b*) is a schematic cross-sectional view showing a primary part of the molding unit in a state that a molding target piece is plastically deformed in the molding process performed by the molding device in FIG. 4(*a*)

FIG. 4(*a*) is a schematic cross-sectional view showing a primary part of the molding unit in a standby mode before the molding (the plastic deformation) in the molding process, and FIG. 4(*b*) is a schematic cross-sectional view showing the primary part of the molding unit in a state that the molding target piece is plastically deformed in the molding process.

The molding unit 29 in the molding device 100 according to this embodiment includes the arms 24 each of which has claws configured to engage with the molding plug 23. An opening/closing operation of each claw is controlled by the control unit, and this claw is a butterfly claw 21 that operates like a butterfly and allows the coupling plug 23 to be coupled with or released from power. When each butterfly claw 21 is opened, this claw engages with the molding plug 23 and locked, and an integral operation realized by coupling of this butterfly claw 21 and the plug 23 enables providing a configuration that realizes instantaneous coupling and release of the power (a butterfly lock mechanism).

The molding device 100 according to this embodiment is characterized in the integral operation with a female molding die as described above, uses the butterfly lock mechanism for coupling with a male die, and is configured to thrust back the temporarily molded male die in the reverse direction. That is, when the molding plug 23 is pulled and the molding is finished, the molding unit 29 can be lifted up, and the pipe 11 can be pulled out from the molding device 100, but one molding time can be reduced by returning the molding plug 23 to the plug holding arm that is in the standby mode in the pipe 11 immediately after the molding. That is, the molding plug 23 instantaneously reciprocates, and an operator manually lifts up the molding unit 29 and removes the workpiece after the molding plug 23 is returned to its original position so that a new unmolded workpiece can be manually inserted. Therefore, a time can be greatly reduced.

As shown in FIG. 4(*a*), in the molding process, first, the pipe 11 having the pilot hole formed in its upper portion is set at a predetermined workpiece arrangement position in the molding device 100 according to this embodiment, and the molding unit 29 moves down by an action of the unit lift-up cylinder (see 28 in FIG. 1). Furthermore, the molding external die 12 provided in the lower portion of the molding unit 29 is installed so as to hold the pipe 11. In this state, the arm 24 coupled with the cylinder rod 14 through a rod bracket 27 moves down while being inserted into the pilot hole of the pipe 11.

Then, each arm 24 is integrated with the molding plug 23 preset at a predetermined position in the pipe 11 when the pair of butterfly claws 21 and 21, which are disposed so as to be associated with both the left and right sides of the pilot hole in the pipe 11 in the longitudinal direction, are opened, and the molding of the pipe 11 based on the upward movement is set in the standby mode. It is to be noted that operations of the lock claws can be controlled by the control unit. The pulling thrust generated from an upper end portion 18 (the piston 16) of each cylinder rod 14 is transmitted to each arm 24 by the rod bracket 27.

Thereafter, in the molding unit 29 that is in the standby mode shown in FIG. 4(*a*), a pressurized oil is supplied to the main cylinder 19 side where the cylinder rod 14 is present. As a result, when the molding plug 23 passes the periphery of the pilot hole of the pipe 11 in the upward direction so as to cross the molding external die 12, the pipe 11 is plastically deformed as shown in FIG. 4(*b*), and the elongated hole is thereby formed in the pipe 11.

(Detail of Operation of Molding Unit)

An operation of the molding unit will now be described in detail.

Figure 5:
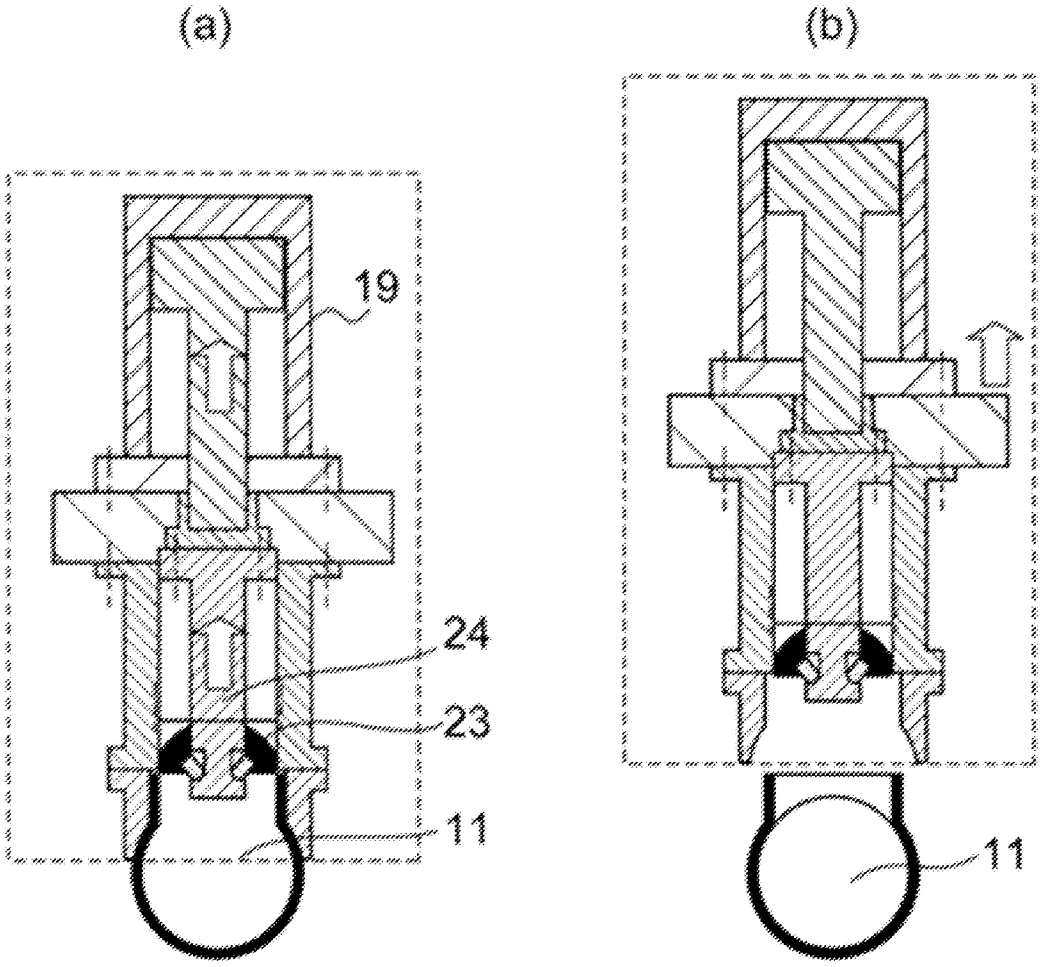
FIG. 5(*a*) is a schematic cross-sectional view of the molding unit showing a state immediately after the molding is finished, and FIG. 5(*b*) is a schematic cross-sectional view of the molding unit showing a state that the molding unit is lifted up and moved away from a pipe after end of the molding in FIG. 5(*a*)

FIG. 5(*a*) is a schematic cross-sectional view of the molding unit showing a state immediately after the molding is completed, and FIG. 5(*b*) is a schematic cross-sectional view of the molding unit showing a state that the molding unit is lifted up and moved away from the pipe after the completion of the molding. Further, FIG. 6(*a*) is a schematic cross-sectional view showing a state that the claws disposed to each arm are opened and the molding plug is locked, and FIG. 6(*b*) is a schematic cross-sectional view showing a state that the claws disposed to each arm are closed and the molding plug is unlocked. Furthermore, FIG. 7(*a*) is a plane view showing the molding plug, FIG. 7(*b*) is a front view showing the molding plug, and FIG. 7(*c*) is a right-side cross-sectional view running through a claw receiver region of the molding plug.

The molding plug 23 set in the pipe 11 engages with the power-coupling arm 24, and the molding of the pipe 11 is finished by a pulling action of the main cylinder 19 (which is arranged to face the upward direction: a direction of an arrow) arranged above the arm 24. Immediately after the end of this molding, a state shown in FIG. 5(*a*) is obtained. After the molding of the pipe 11 is completed, the entire molding unit 29 is lifted up in the upward direction (the direction of the arrow) by the unit lift-up cylinder 28 (see FIG. 2) as shown in FIG. 5(*b*), and it is moved away from the pipe 11.

Figure 6:
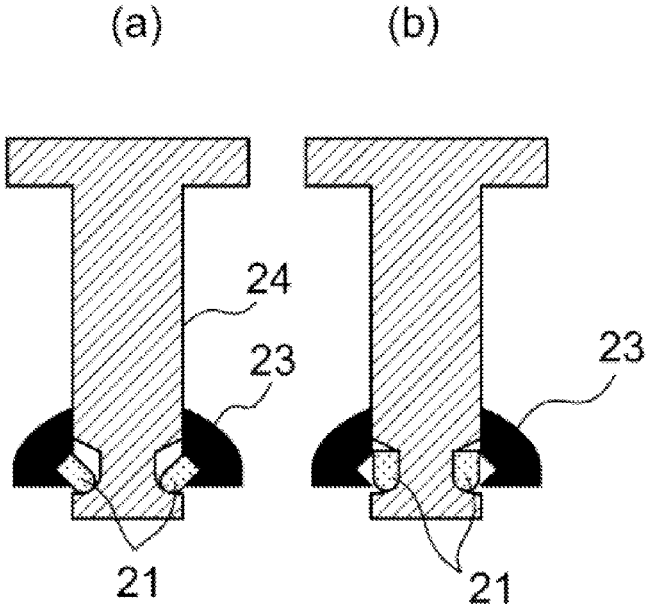
FIG. 6(*a*) is a schematic cross-sectional view showing a state that claws disposed to an arm are opened and a molding plug is locked, and FIG. 6(*b*) is a schematic cross-sectional view showing a state that the claws disposed to the arm are closed and the molding plug is unlocked.

The molding plug 23 and each arm 24 are engaged with each other by an operation of the pair of openable/closable butterfly claws 21 and 21 disposed to both the left and right sides of a position near the lower end of the arm 24 (an end portion on the opposite side of the cylinder rod). That is, as shown in FIG. 6(*a*), when the butterfly claws 21 and 21 provided on the arm 24 are opened, the arm 24 and the molding plug 23 are locked and engaged with each other. On the other hand, as shown in FIG. 6(*b*), when the butterfly claws 21 and 21 provided on the arm 24 are closed, the molding plug 23 is disengaged from the arm 24.

Figure 7:
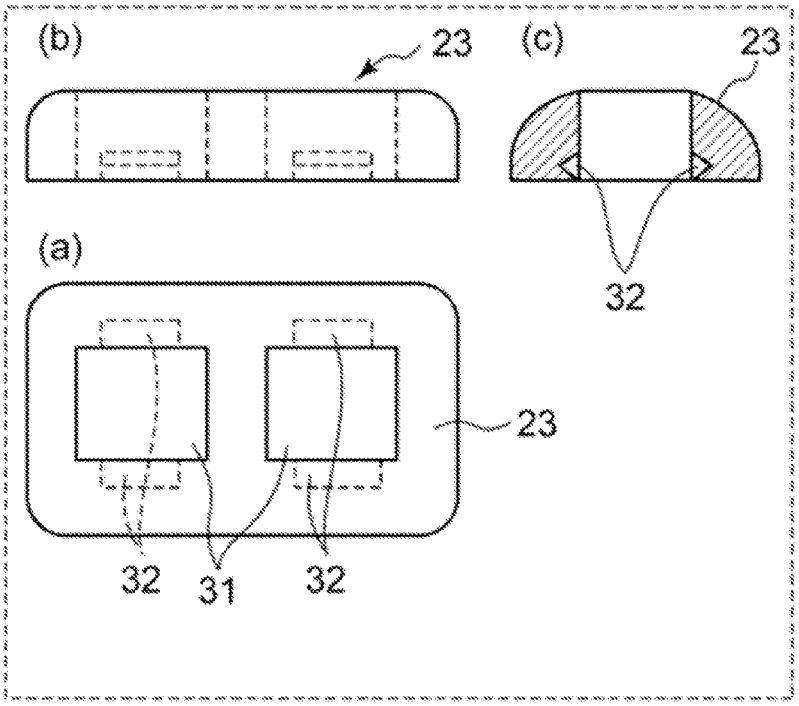
FIG. 7(*a*) is a plan view showing the molding plug, FIG. 7(*b*) is a front view showing the molding plug, and FIG. 7(*c*) is a right-side cross-sectional view running through a claw receiver region of the molding plug.

As shown in FIG. 7(*a*), a plurality of through holes 31 for the arm shafts 24 (coupling shafts) are arranged in the molding plug 23 used in this embodiment. Moreover, a planar bottom portion of the molding plug 23 is provided with claw receivers 32 each of which is carved to have a predetermined shape into which each butterfly claw 21 of the arms 24 is fitted and locked.

Figure 8:
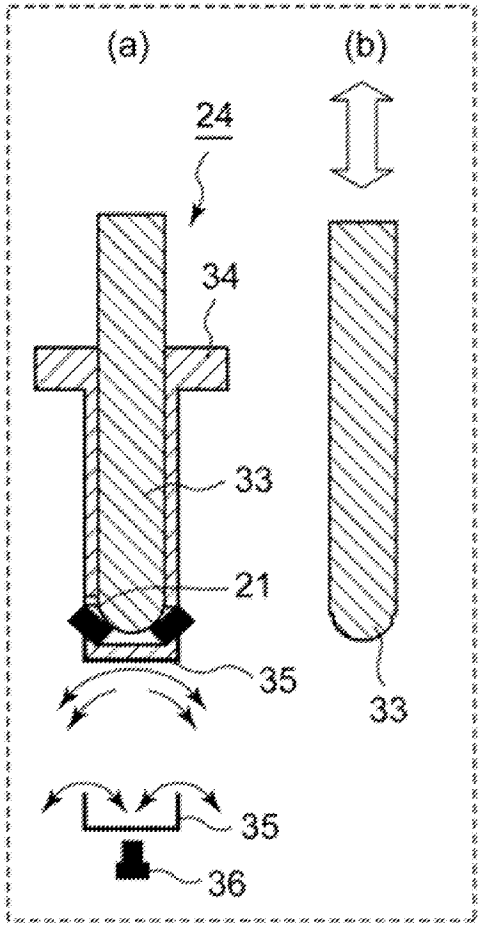
FIG. 8(*a*) is a schematic cross-sectional view showing a configuration of the arm including a butterfly lock mechanism, and FIG. 8(*b*) is a conceptual view showing a claw opening/closing rod that allows butterfly claws to be opened or closed and its operation.

A specific configuration of each arm 24 used in this embodiment is as shown in FIG. 8. FIG. 8(*a*) is a schematic cross-sectional view showing a configuration of each arm including the butterfly lock mechanism, and FIG. 8(*b*) is a conceptual view showing a claw opening/closing rod that exerts an opening/closing action on each butterfly claw and its operation.

As shown in FIG. 8(*a*), the arm 24 is constituted of an arm cylindrical body 34, a claw opening/closing rod 33 that is arranged so as to be vertically movable through the inside of the arm cylindrical body 34, the pair of left and right butterfly claws 21 and 21 that are opened/closed by an action of the claw opening/closing rod 33, and a leaf spring 35 disposed to a bottom portion of the arm 24 by a fixing screw 36.

The butterfly claws 21 are constantly closed by the leaf spring 35 when the claw opening/closing rod 33 does not act thereon. The leaf spring 35 is held by the action for closing the butterfly claws 21. It is to be noted that the claw opening/closing rod 33 operates in the vertical direction by using any one (not shown) of a cylinder, an electromagnetic solenoid, and a mechanical system based on a signal from the control unit. As a result, the butterfly claws 21 and 21 are opened or closed. It is to be noted that the leaf spring 35 that provides force that constantly closes the butterfly claws 21 operates like a spring along arrows shown in FIG. 8(*a*).

(Outline of Operation of Entire Molding Device)

An outline of an operation of the entire molding device according to this embodiment will now be described.

Figure 9:
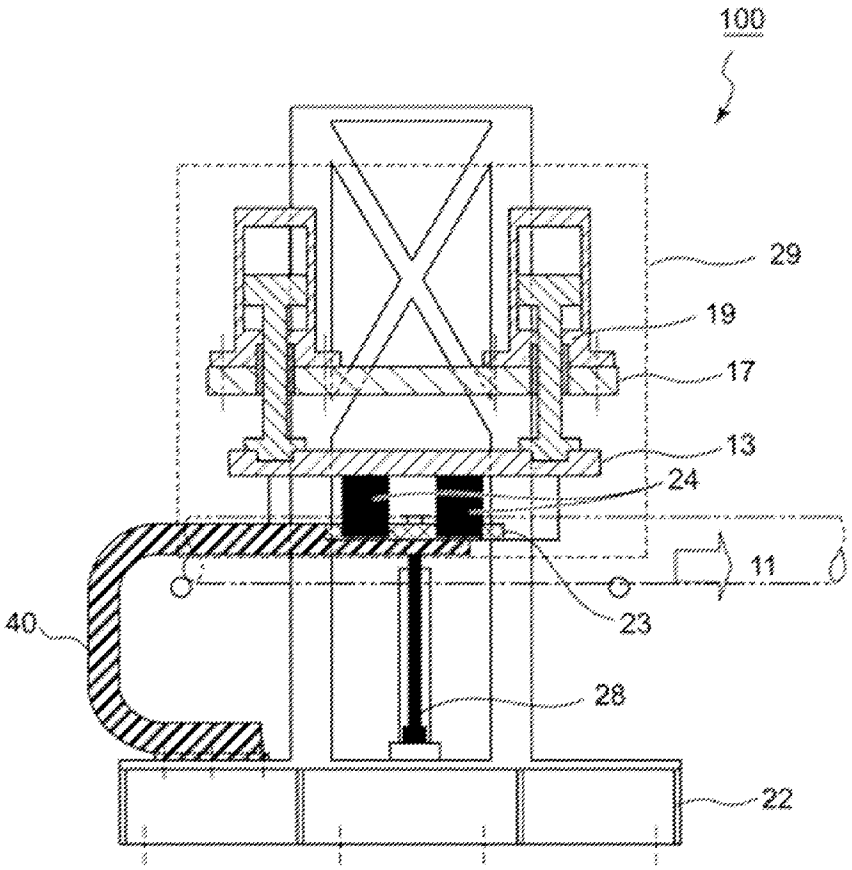
FIG. 9 is a cross-sectional view showing the molding device according to an embodiment of the present invention from a front side.

FIG. 9 is a cross-sectional view showing the molding device according to this embodiment from the front side. A process of forming an elongated hole in the pipe 11 with the use of the molding device 100 according to this embodiment is as follows.

As shown in FIG. 9, in the molding device 100, when the molding plug 23 is held on a plug holding arm 40 provided on the L-shaped frame (a frame base) 22 which is also a drive hydraulic tank and the pipe 11 as a workpiece is inserted into a predetermined position, the molding unit 29 is moved down to a position where it contacts with the pipe 11 by the unit lift-up cylinder 28.

Then, when the molding unit 29 picks up a signal indicative of contact with the pipe 11, the molding unit 29 stops the downward movement, the butterfly claws 21 and 21 incorporated in the molding arms 24 (see FIG. 8) are opened, and the molding plug 23 and the arms 24 are integrated.

Here, force in a shear direction acts on an external contact die of the pipe 11, the molding plug 23, the molding arm 24, and the die base 13 by a high hydraulic pressure that is applied toward the rod side of each main cylinder 19 on the cylinder base 17 fixed to the die base 13, and hence the small pilot hole is formed on the upper side by the molding plug 23 which is a male die.

As described above, using the molding device according to this embodiment enables manufacturing a molded body including an elongated hole with improved strength around its opening portion.

When the molding reaches a position that is set to a predetermined height, a contact sensor (not shown) catches this state, then each molding cylinder 19 is switched to a pressure on the head side, and the molding plug 23 is pushed back to an original position of the plug holding arm 40. This is the end of the molding process, and then the pipe 11 is returned along a direction of an arrow in FIG. 9 by a feed roller (not shown).

INDUSTRIAL APPLICABILITY

The present invention has the industrial applicability as the molding device that can improve strength around the opening portion and reduce a time required for production of a molded body in case of pulling open the desired elongated hole in the molding target piece such as a pipe or a sheet.

REFERENCE SIGNS LIST

100 . . . molding device
11 . . . pipe (workpiece)
12 . . . molding external die
13 . . . die base
14 . . . cylinder rod
15 . . . rod guide metal
16 . . . piston
17 . . . cylinder base
18 . . . cylinder rod end portion
19 . . . main cylinder
21 . . . butterfly claw
22 . . . L-shaped frame
23 . . . molding plug
24 . . . arm
25 . . . guide roller

26 . . . lift bracket
27 . . . rod bracket
28 . . . unit lift-up cylinder
29 . . . molding unit
31 . . . through hole
32 . . . claw receiver
33 . . . claw opening/closing rod
34 . . . arm cylindrical body
35 . . . leaf spring
36 . . . fixing screw
40 . . . plug holding arm

The invention claimed is:

1. A molded body manufacturing method for pulling open a desired elongated hole in a molding target piece, the method comprising:

closing a claw of an arm such that an outer surface of the claw is coplanar with an outer surface of the arm;

moving the arm from an upper side toward a lower side of a pilot hole in a molding target piece in the direction substantially perpendicular to a surface of the molding target piece in which the pilot hole is provided, the pilot hole being smaller than but substantially concentric with a desired elongated hole to be formed in the molding target piece;

inserting the arm into a molding plug and opening the claw such that the outer surface of the claw is oblique to the outer surface of the arm; and engaging the arm with the molding plug and moving the arm and the molding plug from the lower side toward the upper side of the pilot hole to form the elongated hole in the molding target piece.

* * * * *